United States Patent [19]

Stutz et al.

[11] 4,036,445

[45] July 19, 1977

[54] CIRCUIT ARRANGEMENT FOR MONITORING THE OPERATION OF AN ELECTRONIC YARN CLEARER

[75] Inventors: Hansruedi Stutz, Dietlikon; Hans Späni, Zurich, both of Switzerland

[73] Assignee: Aktiengesellschaft Gebruder Loepfe, Wetzikon, Switzerland

[21] Appl. No.: 569,786

[22] Filed: Apr. 21, 1975

[30] Foreign Application Priority Data

May 15, 1974 Switzerland ..... 6637/74

[51] Int. Cl.[2] ..... B65H 63/02; D01H 13/22; D02J 1/14; G01L 5/04

[52] U.S. Cl. ..... 242/37 A; 28/226; 73/160; 83/522

[58] Field of Search ..... 242/36, 37 R, 37 A; 73/160; 28/64; 83/522

[56] References Cited

U.S. PATENT DOCUMENTS

| | | | |
|---|---|---|---|
| 3,043,991 | 7/1962 | Schneider et al. | 317/DIG. 2 |
| 3,122,956 | 3/1964 | Tucker | 324/61 R |
| 3,476,329 | 11/1969 | Felix | 242/36 |
| 3,648,027 | 3/1972 | Ganong et al. | 242/36 |
| 3,748,707 | 7/1973 | Aihara et al. | 73/160 |
| 3,863,241 | 1/1975 | Kamiyamaguchi et al. | 242/37 R |

*Primary Examiner*—Steven L. Stephan
*Attorney, Agent, or Firm*—Werner W. Kleeman

[57] ABSTRACT

A circuit arrangement for monitoring the operation of an electronic yarn clearer on an automatic yarn winding machine and particularly for monitoring the operation of the output relays and yarn cutting device of the yarn clearer. Logic circuitry is provided for combining the output signals of the yarn clearer circuitry and produces control and/or alarm signals when the cutting device fails to sever the yarn upon appearance of a cutting pulse, i.e. when a yarn travel signal is permanently present during a predetermined time interval commencing with the start of said cutting pulse.

6 Claims, 5 Drawing Figures

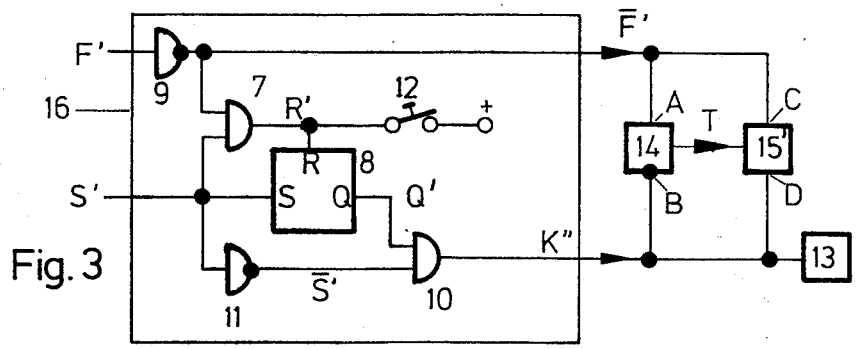
Fig. 3
Fig. 4
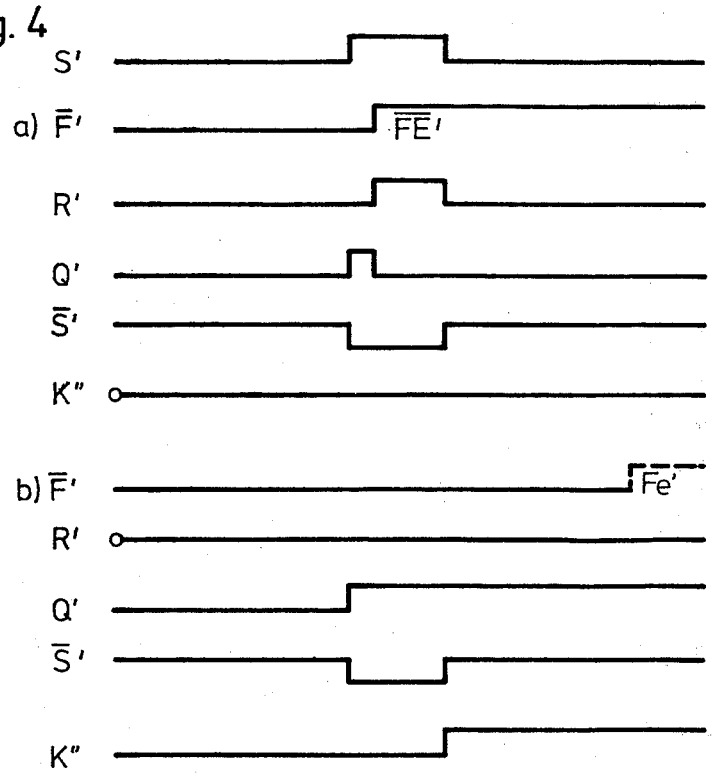
Fig. 5
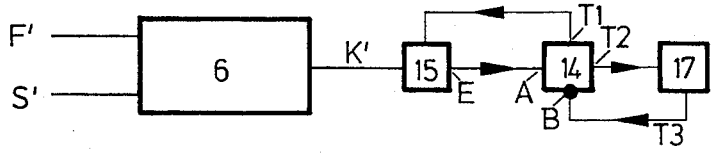

CIRCUIT ARRANGEMENT FOR MONITORING THE OPERATION OF AN ELECTRONIC YARN CLEARER

BACKGROUND OF THE INVENTION

The present invention relates to a new circuit arrangement for monitoring the operation of an electronic yarn clearer mounted on an automatic yarn winding machine which comprises at least one winding station and at least one automatic knotting device, and is equipped with means for stopping the winding operation when the yarn breaks or is cut by intervention of the electronic yarn clearer, and means for actuating said automatic knotting device in this event. One such well known automatic yarn winding machine is the "Autoconer" manufactured by the firm W. Schlafhorst & Co, Moenchengladbach, West Germany.

Generally such an electronic yarn clearer comprises a device for sensing a transverse dimension, e.g. the diameter, of the traveling yarn, an electronic circuit serially connected to said sensing means and provided with a first output stage for generating cutting pulses due to incorrect yarn transverse dimension, and a second output stage for generating continuous signals indicative of yarn travel, or failure of yarn or yarn travel. It is known in the art to use the output signals of said output stages for controlling the winding and knotting operations mentioned above.

Now in factories equipped with a multiplicity of such automatic yarn winding machines and often comprising hundreds or even thousands of yarn winding units or stations it is an essential requirement to povide for automatic monitoring and protecting the electronic yarn clearers cooperating with the winding stations.

So-called primary events or deficiencies, as failure of a yarn sensing device or breakdown of the supply voltage of the electronic yarn clearer may be monitored without difficulty. Such primary events are characterized by the absence of electrical signals, such as the yarn sensing signals or supply voltages in the electronic circuitry of the yarn clearer, and may be detected for triggering an alarm by usual electric or electronic means.

However, it is not possible to protect and monitor the output mechanisms or members of an electronic yarn clearer by such known electric or electronic means.

SUMMARY OF THE INVENTION

Thus, it is a primary object of the invention to provide a novel circuit arrangement for monitoring the operation of the output mechanisms or members of an electronic yarn clearer and for protecting the yarn clearer and the equipment of the yarn winding machine which is actued upon by such output mechanisms and members from faulty operation.

Further it is an object of the invention to monitor the output relay or relays and the mechanism of the yarn cutting or severing device which may fail to operate orderly even if the electronic circuitry of the yarn clearer works correctly and furnishes regular output signals to said relays or mechanism or other members controlled by said output signals.

Another more specific objective of the invention is the provision of monitoring arrangement by which malfunction of the cutting blade or knife of the yarn cutting device can be detected, i.e. when the knife becomes dull or jammed so that the yarn is not severed when a cutting pulse appears. Such so-called secondary events cannot be detected by the known means provided for monitoring the primary events.

Now in order to implement the aforementioned objectives and others which will become more readily apparent as the description proceeds, the monitoring arrangement of the invention is generally characterized by monitoring or logic circuitry having first and second inputs, the first input being operatively connected to the first output stage of the electronic yarn clearer, and the second input stage being operatively connected to the second output stage thereof, said logic circuitry comprising logic means for combining said cutting pulses and continuous signals into at least one logic output signal indicative of continued yarn travel during a pedetermined time interval commencing with said cutting pulse, and thus indicative of failure of the yarn cutting device.

BRIEF DESCRIPTION OF THE DRAWINGS

The invention will be better understood and objects other than those set forth above will be apparent upon consideration of the following detailed description thereof which makes reference to the annexed drawings wherein:

FIG. 3 is a block diagram of a second embodiment of the invention, FIG. 4 is a graphic representation of the signals occurring in the circuitry shown in FIG. 3 in the cases mentioned under FIG. 2, and FIG. 5 is a simplified block diagram of a third embodiment of the invention.

DETAILED DESCRIPTION OF THE INVENTION

Figure 1:
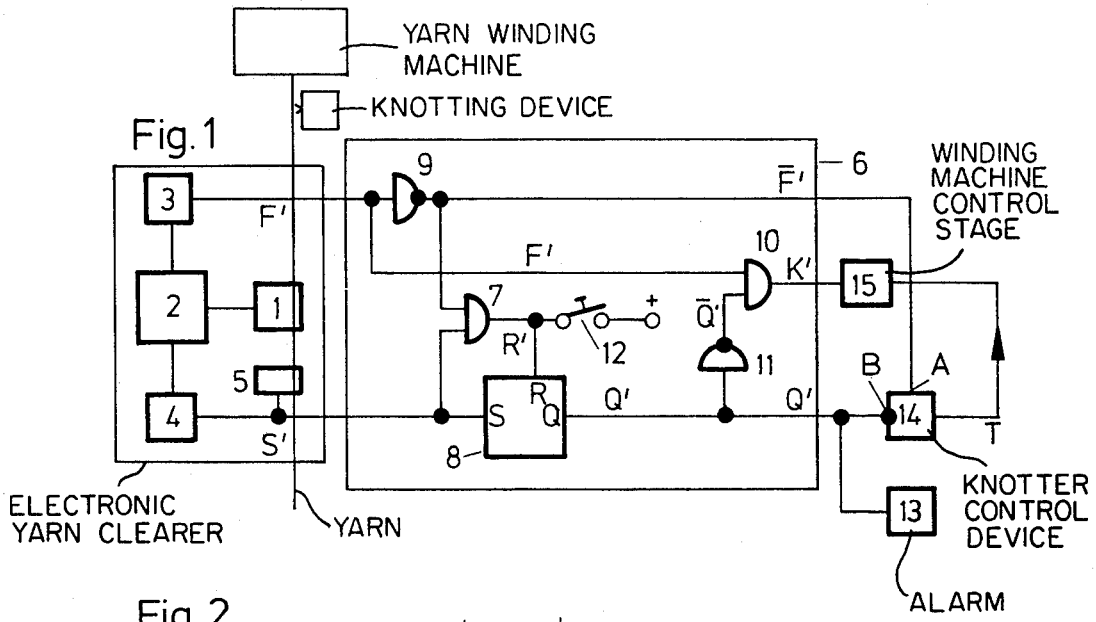
FIG. 1 is a block diagram of a first embodiment of the invention.

In FIG. 1, an electronic yarn clearer comprises, among others the parts 1 through 5, and is operatively connected with monitoring circuit 6. The latter has three outputs $\overline{F}'$, K' and Q' to which are connected three commanding devices, i.e. an alarm device 13, a knotter control device 14 and a stage 15 controlling the clutch of a winding station which is part of the automatic yarn winding machine (not shown in the Figures). Briefly, knotter control device 14 will be called control device, and stage 15 control stage.

The electronic yarn clearer comprises a device 1 for sensing a transverse dimension, e.g. the diameter, of a traveling yarn, which sensing device may be of the opto-electrical kind known in the art. An electronic evaluation circuit 2 is connected operatively to the sensing device 1 and has first and second output stages, namely a cutting signal output stage 4 and a thread signal output stage 3. A yarn cutting device 5 is operatively connected to the cutting signal output stage 4.

The thread signal output stage 3 generates continuous yarn travel signals indicative of the presence of a traveling yarn in the sensing device 1, or continuous failure signals of another magnitude in the case where no yarn is present, or when the yarn is at a standstill in the sensing device 1. The cutting signal output stage 4 generates a cutting pulse in response to an incorrect yarn transverse dimension, e.g. when the local diameter of the yarn section passing the sensing head goes beyond an upper and/or lower threshold which deviates by a predetermined amount from a nominal value of the yarn diameter. The generation in an electronic yarn clearer of continuous yarn travel signals, yarn failure signals when no yarn is present and signals indicative of yarn standstill, i.e., yarn present but not traveling, based on measurement of yarn transverse dimension is accomplished by apparatus known in the art as exemplified by the apparatus disclosed in U.S. Pat. Nos. 3,122,956 and 3,043,991.

The output stages 3 and 4 may each comprise a controllable device, e.g. a relay, a controllable rectifier device or a transistor which is controlled by the output signals of evaluation circuit 2. It may be assumed that during the winding operation the yarn travels in the direction from cutting device 5 to sensing device 1.

Figure 2:
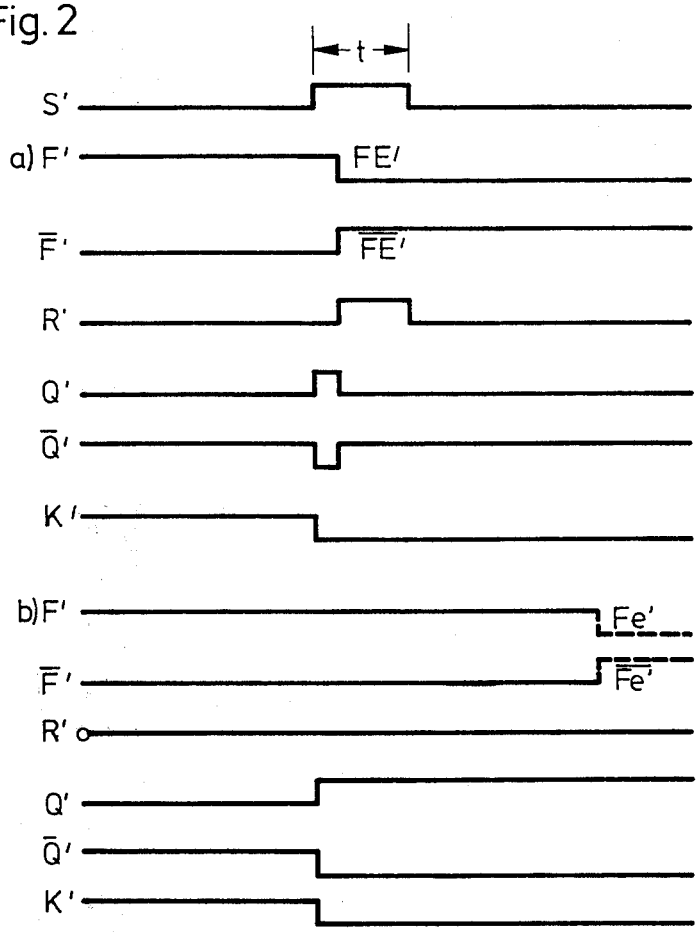
FIG. 2 is a graphic representation of the signals occurring in the circuitry shown in FIG. 1, a) in the case of successful cutting operation, and b) when the cutting device fails to sever the yarn upon actuation by a cutting pulse.

As shown in FIG. 2, the cutting pulse S' generated by output stage 4 in cooperation with evaluation circuit 2 is of predetermined duration *t.* Cutting pulse S' causes normally, that is to say when cutting device 5 operates correctly, the yarn to be severed. As long as the yarn is traveling, thread signal output stage 3 furnishes a continuous signal F' indicative of yarn travel, the signal being in the present case a positive DC-signal or logic L signal as shown in FIG. 2 at a). Severing the yarn causes the yarn travel signal F' to drop to zero which represents a failure signal FE' or logic O signal. The continuous failue signal FE' which appears immediately after the outset of the cutting pulse S' serves as a criterion for the orderly operation of cutting device 5.

In the case that the cutting device is arranged downstream of the sensing device with respect to the yarn travel, one yarn end may remain in the sensing device after severing, in which case the failure signal may be delayed by a small time interval.

The monitoring circuit or logic circuit 6 serves for combining logically the cutting pulses S' and continuous signals F'. Logic circuit 6 generates logic output signals O', K' and $\overline{F'}$ which serve as control and alarm signals for the commanding devices 13, 14 and 15, respectively.

Logic circuit 6 comprises first and second gating means, each consisting of a negation gate 9 or 11, respectively, and an AND-gate 7 or 10, respectively, and further comprises a bistable circuit 8 arranged as a RS-flipflop, and a push button 12 for resetting the RS-flipflop.

As long as logic O signals are present at the inputs R and S of RS-flipflop 8, the output signal O' thereof is also a logic O signal. RS-flipflop 8 is set by a logic L signal at input S, whereby O' becomes logic L. By a logic L signal at input R the RS-flipflop 8 is reset, and O' becomes logic O again. Alarm device 13 may be an acoustical or optical alarm apparatus. It can be assumed that an alarm is caused by a positive or logic L-signal of predetermined minimum duration.

Control device 14 affecting the knotting device of the yarn winding machine has a trigger input A and an inhibit input B. A knotting operation is initiated by a positive or logic L control signal $\overline{F'}$ of a predetermined minimum duration appearing at input A, whereas a positive control or logic L signal O' of predetermined minimum duration occurring at input B inhibits the knotting operation.

Control stage 15 which has first and second inputs acts upon the clutch of the winding station with which there is operatively associated the sensing device. The winding station is operative as long as a positive logic or L-signal is present at the input of controlstage 15 and is rendered inoperative by a logic O-signal.

Control signal Q' produced by logic circuit 6 is supplied to alarm device 13 and inhibit input B of control device 14. The negated or inversed yarn travel signal $\overline{F'}$ is fed to trigger input A of control device 14, and control signal K' is passed to the first input of control stage 15.

Between control device 14 and second input of control stage 15 there is provided an operational connection T. By this connection, a positive pulse from control stage 14 triggers control stage 15 during a short time interval after completion of a knotting operation to put the winding procedure into operation.

In logic circuit 6, set input S of RS-flipflop 8 is connected to the output of cutting signal output stage 4 of the electronic yarn clearer, so that the cutting pulse S' is delivered to set input S. Reset input R of RS-flipflop 8 is connected to the output of first AND-gate 7 which generates conjunction signal R'. The negated yarn travel signal $\overline{F'}$ from first negation gate 9 and cutting pulse S' are supplied to the first and second inputs of AND-gate 7. Output signal O' from output O of RS-flipflop 8 is passed through second negation gate 11 to one of the inputs of second AND-gate 10 whose other input receives continuous yarn travel signal F'. AND-gate 10 furnishes control signal K'.

Now the mode of operation of the embodiment shown in FIG. 1 will be described with reference to FIG. 2, in the event that during the occurence of a cutting pulse S' (a) a failure signal appears indicating correct operation of the cutting device 5, and (b) no such failure signal appears, which means that the cutting device 5 does not work orderly.

When the winding operation proceeds normally, i.e. with S' = O, F' = L, $\overline{F'}$ = O, control stage 15 keeps the clutch of the winding station in its working position. In this event, control signal K' is logic L.

In FIG. 2, cutting pulse S' is shown as a positive rectangular pulse. The duration of this pulse is generally at least 20 milliseconds and may be substantially longer.

According to FIG. 2, a) yarn travel signal F' = L turns into a failure signal FE', i.e. a O-signal, immediately, that means a few milliseconds after the start of the cutting pulse S'. The conjunction of S' and the negated failure signal $\overline{FE'}$ in first AND-gate 7 furnishes a positive rectangualr conjunction pulse R'. When RS-flipflop 8 is set by cutting pulse S' and reset by conjunction pulse R' a short rectangular pulse Q' appears at output Q of RS-flipflop 8. The conjunction of negated pulse Q' and yarn travel signal F' in second AND-gate 10 furnishes an output signal K' which jumps from logic L to logic O with the commencement of cutting pulse S'.

Logic output pulse O' because of its short duration of some milliseconds does not affect alarm device 13 and control device 14 so that the latter is not locked. Thus, the knotting device is actuated by negated failure signal $\overline{FE'}$ acting upon trigger input A of control device 14 after the winding operation is stopped by control signal K' acting on control stage 15. After completion of the knotting operation control stage 15 is triggered through operational connection T so that the winding station is put in operation again. With the now appearing yarn travel signal F' = L the winding station continues to operate after triggering. This is the regular operation following a succesful cutting operation.

As illustrated in FIG. 2 under (b) no failure signal appears during the period of cutting pulse S', and conjunction signal R'continues to be O. RS-flipflop 8 is set by cutting pulse S' but is not reset by conjunction signal R' so that output signal O' jumps from O to L when cutting pulse S' commences, and continues to be L. In this case, control signal K' has the same shape as under (a) and causes the winding operation to be stopped. Upon such stopping a delayed failure signal Fe' appears in the place of yarn travel signal F' which failure signal does not modify control signals Q' and K'. By the positive going section of control signal Q' control device 14 and the thereby controlled knotting device are locked, and alarm device 13 is actuated. Since now the knotter control device 14 is not operated, winding control stage 15 is not actuated through operational connection T, and the winding station is not put into operation as in case (a). However, the actuation of alarm device 13 advises the operator of the winding machine to rapair the defect. After RS-flipflop 8 is manually reset by pressing push button 12, control device 14 is unlocked, and the winding operation can be started again.

It is noted that with the normally running winding operation when no cutting pulse occurs (F' = L, S' =0) control signal K' is L. When in this case the yarn breaks without intervention of the electronic yarn clearer, a failure signal FE' = O or FE' = O appears depending upon whether the yarn breaks upstream or downstream of the sensing device 1, and control signal K' goes to O, whereas control signal Q' is and continues to be O. As in case (a) knotter control device 14 is not locked, winding control stage 15 is triggered to stop the winding operation, and the knotting device is actuated.

With reference to FIG. 3, the parts 1 through 5 of the yarn clearer are not shown in this Figure. They may be construed to be and to operate in a similar way as illustrated with reference to FIG. 1.

The monitoring circuit 16 shown in FIG. 3 comprises similar components as monitoring circuit 6 of FIG. 1, i.e. first and second negation gates 9, 11, a RS-flipflop 8, first and second AND-gates 7, 10 and a push button 12. The components 7, 8, 9 and 10 are interconnected as in FIG. 1. However, contrary to FIG. 1, the second negation gate 11 is connected to the S' output of the electronic yarn clearer, and the two inputs of second AND-gate 10 are connected to output O of RS-flipflop 8 and the output of negation gate 11, respectively. The logic output signal K'' of the second AND-gate 10 serves as control signal acting on the commanding devices 13, 14 and 15'.

Monitoring circuit 16 generates only two control signals $\overline{F'}$ and K'' in place of the three control signals F', K' and Q' of monitoring circuit 6, FIG. 1. Now control signal K'' takes over the functions of the two control signals K' and Q'.

Knotter control device 14 and alarm device 13 may be construed as described with reference to FIG. 1. Thus, these devices are not affected by a O-signal, however, are actuated by a L-signal. Contrary to control stage 15 of FIG. 1, control stage 15' of the winding station has two inputs C and D receiving control signals $\overline{F'}$ and K'', respectively. Also, an operational connection T exists from control device 14 to control stage 15'. Contrary to control stage 15 of FIG. 1, control stage 15' is not affected by a O-signal, that means the winding station continues to operate with such a signal and is stopped when a L-signal appears.

FIG. 4 serves for illustrating the mode of operation of the equipment shown in FIG. 3 for the working sequences (a) and (b) of the winding station and yarn clearer already discussed with reference to FIGS. 1 and 2.

The shape of signals S' and F' is assumed to be similar to the one shown in FIG. 2, thus resulting in similar shapes of control signals R' and Q'. However, control signal K'' is of a shape different from the one of control signal K'.

According to case (a), FIG. 4, i.e. when a cutting pulse S' is followed by a successful severing action and thus a failure signal $\overline{FE'}$, control signal K'' is and continues to be O, which O-signal does not influence commanding devices 13, 14 and 15. However, since failure signal $\overline{FE'}$ is L, the winding station is stopped through control stage 15, and a knotting operation is triggered over control device 14. As in case (a), FIG. 2, winding control stage 15 is triggered through operational connection T after completion of the knotting operation, whereby the winding station is restarted.

In case (b), i.e. if cutting pulse S' does not result in a yarn severing action, control signal K'' jumps from O to L at the end of cutting pulse S'. Thereby, the winding station is stopped by control stage 15', the knotter is locked through inhibit input B of control device 14, and alarm device 13 is triggered as in case (b), FIG. 2. Thereafter, the defect may be eliminated as described with reference to FIG. 2.

During a normal winding operation when no cutting pulse occurs, the two control signals $\overline{F'}$ and K'' are O. When in this case the yarn breaks without action of cutting device 5, a failure signal $\overline{FE'}$ = L appears so that the further actions are initiated as described with reference to case (a), by controls 14 and 15. Control signal K'' remains O an has no action in this case.

FIG. 5 shows an electronic monitoring circuit 6 construed like the one of FIG. 1 and connected to an electronic yarn clearer as described with reference to that Figure. Control device 14 has two inputs A and B as in FIG. 1, and control stage 15 has first and second inputs for receiving signals K' and T1, respectively.

The K'-output of logic circuit 6 is connected directly to the first input of control stage 15, however, the logic output signals $\overline{F'}$ and Q', FIG. 1, are not used as control signals. Output E of control stage 15 is connected to trigger input A of control device 14. The latter has a first output T1 for triggering control stage 15 through the second input thereof, and a second output T2 for generating counting pulses for counter 17. Output T3 of counter 17 is connected to inhibit B of control device 14.

This embodiment is advantageous with respect to its using only a single connection between logic circuit 6 and the controls of the winding machine.

In case (a) when a severing operation was successful, the winding station is stopped through control stage 15, as described in connection with FIGS. 1 and 2, further on the knotting device is operated through control device14 being actuated from output E, and control stage 15 triggered temporarily over connection T1, thus putting the winding station into operation for a short time interval. With a successful knotting operation, yarn travel signal F' appears as a L-signal, and also control signal K' becomes L so that the winding operation continues after the end of the trigger pulse from T1. With an unsuccessful knotting operation, a failure signal FE' = O appears. In this event, K' becomes O and the winding station ceases operating after termination of the trigger pulse. Thereon, the knotting device is actuated again. On completion of a predetermined number of unsuccessful knotting operations counter 17 generates an inhibit signal supplied over connection T3 to input B of control device 14 which is no longer actuated and thus does not trigger control stage 15 over operational connection T1.

In case (b), i.e. when cutting pulse S' is not followed by a failure signal FE', the winding operation is also stopped in the manner already described with reference to FIG. 2. Further on, the knotting device is operated and control stage 15 triggered as in case (a). Though a yarn travel signal F' = L appears now, the output signal K' remains O since RS-flipflop 8 is set as demonstrated with reference to FIG. 2, case (b), and the input signal O' of AND-gate 10 is O. Thus, the winding operation is not maintained upon triggering, so that the defect must be repaired by pressing key 12, before the winding station can be put into operation again.

With respect to the practicability of the invention the polarity of the signals F' and S' generated by the signal output stages 3 and 4, respectively, is not important since those signals may be changed into signals of inverse polarity by negation gates.

With the embodiments described with reference to FIGS. 1–4 it is assumed that in case (a) of a successful cutting operation yarn travel signal F' = L must disappear during the duration *t* of cutting pulse S', in order to stop the winding operation and operate the knotting device.

However, when the cutting device 5 is arranged a considerable distance downstream of the sensing device and the cutting pulse S' is of short duration, it may occur that after a successful severing operation failure signal FE' appears only after termination of cutting pulse S'. In this event, a delayed or extended pulse derived from the cutting pulse should be used. Such a pulse may be gained e.g. by providing a flipflop in the S' input connection of logic circuit 6 or 16. While there is shown and described present preferred embodiments of the invention, it is to be distinctly understood that the invention is not limited thereto, but may be otherwise variously embodied and practiced within the scope of the following claims.

Accordingly, what is claimed is:

1. An electronic yarn clearer mounted on an automatic yarn winding machine provided with an automatic yarn knotting device, said electronic yarn clearer comprising yarn transverse dimension sensing means, an electronic circuit serially connected to said sensing means and having a first output stage means for generating cutting pulses indicative of incorrect yarn transverse dimension, and a second output stage means for generating continuous signals indicative of yarn travel, or signals indicative of failure of yarn travel or yarn, said failure signal serving for inhibiting the winding operation and actuating the yarn knotting device, and further comprising a circuit arrangement for detecting incorrect operation of the electronic yarn clearer, said circuit arrangement having a first input operatively connected to said first output stage means and a second input operatively connected to said second output stage means, and comprising logic means for combining said cutting pulses and continuous signals into at least one logic output signal indicative of continued yarn travel during a predetermined time interval commencing with said cutting pulse.

2. The electronic yarn clearer as defined in claim 1, wherein said circuit arrangement comprises first gating means for combining a cutting pulse and the negated continuous signal into a conjunction signal, and a flipflop circuit having a set input receiving the cutting pulse and a reset input receiving said conjunction signal, so that when the flipflop is set by a cutting pulse, resetting of the flipflop occurs only if a yarn travel signal is present at the outset of and disappears during said predetermined time interval commencing with said cutting pulse.

3. The electronic yarn clearer as defined in claim 2, further comprising second gating means for combining a yarn signal and the negated output signal of the flipflop circuit into a logic output signal which serves for controlling the winding operation.

4. The electronic yarn clearer as defined in claim 2, further comprising second gating means for combining a negated cutting pulse and the output signal of the flipflop circuit into a logic output signal which serves for controling the winding operation and knotting device.

5. In an electronic yarn clearer mounted on a yarn winding machine and comprising yarn transverse dimension sensing means; and electronic circuit operationally connected to said sensing means and having a first output stage means for generating cutting pulses indicative of incorrect yarn transverse dimension, and a second output stage means for generating continuous signals indicative of yarn travel, or signals indicative of failure of yarn travel or yarn; and yarn cutting means controlled by said cutting pulses; a circuit arrangement for detecting failure of the yarn cutting means, said circuit arrangement having a first input operatively connected to said first output stage means and a second input operatively connected to said second output stage means, and comprising logic means for combining said cutting pulses and continuous signals into at least one logic output signal indicative of continued yarn travel during a predetermined time interval commencing with said cutting pulse.

6. The electronic yarn clearer as defined in claim 5, comprising first gating means for combining a cutting pulse and the continuous signal into a conjunction signal, and a flipflop circuit having a set input receiving the cutting pulse and a reset input receiving said conjunction signal, such that, when the flipflop is set by a cutting pulse, resetting of the flipflop occurs only if the yarn travel signal is present at the outset of and disappears during said predetermined time interval commencing with said cutting pulse.

* * * * *